US009662701B2

(12) United States Patent
Wei et al.

(10) Patent No.: US 9,662,701 B2
(45) Date of Patent: May 30, 2017

(54) METHOD FOR FORMING NON-RECTANGULAR SECTION RING FROM RECTANGULAR SECTION RING

(71) Applicant: GUIZHOU ANDA AVIATION FORGING CO., LTD, Anshun (CN)

(72) Inventors: Zhijian Wei, Anshun (CN); Yongfu Xie, Anshun (CN); Longxiang Wang, Anshun (CN); Haiyan Zhang, Anshun (CN)

(73) Assignee: GUIZHOU ANDA AVIATION FORGING CO., LTD., Anshun (CN)

( * ) Notice: Subject to any disclaimer, the term of this patent is extended or adjusted under 35 U.S.C. 154(b) by 599 days.

(21) Appl. No.: 14/285,663

(22) Filed: May 23, 2014

(65) Prior Publication Data

US 2014/0260501 A1 Sep. 18, 2014

Related U.S. Application Data

(63) Continuation-in-part of application No. PCT/CN2012/084952, filed on Nov. 21, 2012.

(30) Foreign Application Priority Data

Nov. 24, 2011 (CN) ..... 2011 1 0377020

(51) Int. Cl.
*B21D 31/04* (2006.01)
*B21K 1/76* (2006.01)
(Continued)

(52) U.S. Cl.
CPC ..... *B21D 31/04* (2013.01); *B21D 37/16* (2013.01); *B21D 39/20* (2013.01); *B21D 41/028* (2013.01); *B21K 1/761* (2013.01); *B21K 21/16* (2013.01)

(58) Field of Classification Search
CPC ..... B21D 31/04; B21D 37/16; B21D 39/20; B21D 41/028; B21D 51/2646; B21K 1/063; B21K 1/40; B21K 1/761; B21K 21/16
See application file for complete search history.

(56) References Cited

U.S. PATENT DOCUMENTS 1,839,530 A * 1/1932 Braun ..... B21K 1/761 29/34 R
3,078,905 A * 2/1963 Somers ..... B21D 53/16 72/355.4

(Continued)

*Primary Examiner* — Edward Tolan
(74) *Attorney, Agent, or Firm* — Matthias Scholl, PC; Matthias Scholl

(57) ABSTRACT

A method for expanding a rectangular section ring to form a non-rectangular section ring. The method includes heating a rectangular section ring of an alloy to a temperature of between 1000 and 1020° C., preheating an expanding block to a temperature of between 260 and 320° C., nesting the inner circumferential surface of the rectangular section ring on the outer circumferential surface of the expanding block; enabling the expanding block to press the inner circumferential surface of the ring in the radial direction, expanding the inner and outer diameter of the rectangular section ring and decreasing the wall thickness thereof for deforming the rectangular section ring to yield a profiled ring billet, whereby finishing a first expanding; rotating the profiled ring billet for 45° along the central axis, whereby finishing a first rotation; and repeating the expanding process and the rotation to obtain a non-rectangular section ring.

8 Claims, 6 Drawing Sheets

(51) Int. Cl.

| | |
|---|---|
| ***B21D 37/16*** | (2006.01) |
| ***B21D 39/20*** | (2006.01) |
| ***B21D 41/02*** | (2006.01) |
| *B21K 21/16* | (2006.01) |

(56) References Cited

U.S. PATENT DOCUMENTS

| | | | | | |
|---|---|---|---|---|---|
| 3,867,208 | A * | 2/1975 | Grekov | C22F 1/183 | 148/407 |
| 4,901,557 | A * | 2/1990 | Schmidt | B21D 51/2646 | 72/370.08 |
| 5,022,254 | A * | 6/1991 | Kramer | B21D 51/2646 | 413/69 |
| 5,115,655 | A * | 5/1992 | Martin | B21H 1/06 | 72/68 |
| 2009/0301162 | A1 * | 12/2009 | Hodjat | B21D 53/16 | 72/339 |

* cited by examiner

METHOD FOR FORMING NON-RECTANGULAR SECTION RING FROM RECTANGULAR SECTION RING

CROSS-REFERENCE TO RELATED APPLICATIONS

This application is a continuation-in-part of International Patent Application No. PCT/CN2012/084952 with an international filing date of Nov. 21, 2012, designating the United States, now pending, and further claims priority benefits to Chinese Patent Application No. 201110377020.7 filed Nov. 24, 2011. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates to a method for expanding a ring, and more particularly to a method for expanding a rectangular section ring to form a non-rectangular section ring.

Description of the Related Art

The rectangular section ring (referring to a ring having a rectangular cross section) or the non-rectangular section ring (referring to a ring having a non-rectangular section) of the high temperature alloy generally has poor dimensional accuracy after being rolled by a ring rolling machine due to the limitations of the rolling process and the rolling device. Only when the ring has an ideal shape and the device presents relatively excellent performance, the dimensional accuracy is approximately between 3% and 5% of the corresponding dimension. Besides, defects including warp, deformation, and even cracking easily occur on the ring as a result of a relatively large stress in subsequent processing operations.

Conventional methods for expanding of a ring are based on the flexible contact between the liquid and an inner circumferential surface of the ring. The methods are only applicable for materials having small deformation resistance and mainly operate to reinforce the ring. However, the methods are neither applicable for materials having large deformation resistance, such as a high temperature alloy, nor applicable for expanding a rectangular section ring into a non-rectangular section ring. Furthermore, the methods are unable to solve the poor dimensional accuracy existing in the prior art.

SUMMARY OF THE INVENTION

In view of the above-described problems, it is one objective of the invention to provide a method for expanding a rectangular section ring to form a non-rectangular section ring. The method utilizes an expanding block to deform a rectangular section ring of a high temperature alloy into a non-rectangular section ring. One large deformation and three continuous small deformations are conducted to expand the high temperature rectangular section ring, thereby obtaining the non-rectangular section ring having high dimensional accuracy.

To achieve the above objective, in accordance with one embodiment of the invention, there is provided a method for expanding a rectangular section ring to form a non-rectangular section ring, the method comprises:

1) providing an expanding machine comprising a mandrel slider, a radial slider, and an expanding block, the expanding block comprising an outer circumferential surface matching an inner circumferential surface of a finally-obtained non-rectangular section ring;
2) heating a rectangular section ring of an alloy comprising an inner circumferential surface to a temperature of between 1000 and 1020° C., preheating the expanding block to a temperature of between 260 and 320° C., nesting the inner circumferential surface of the rectangular section ring on a periphery of the outer circumferential surface of the expanding block of the expanding machine, and allowing the radial slider in an aggregated state;
3) starting the expanding machine, exerting an axial tension F on the mandrel slider to enable the mandrel slider to move downward along an axial direction and to press an inner conic surface of the radial slider thereby synchronously dispersing each part of the radial slider in a radial direction; allowing the expanding block disposed on an outer circumferential surface of the radial slider to press the inner circumferential surface of the rectangular section ring in the radial direction; and expanding an inner diameter and an outer diameter of the rectangular section ring and decreasing a wall thickness thereof for deforming the rectangular section ring to yield a profiled ring billet, whereby finishing a first expanding, during which, an expanding temperature of the rectangular section ring is controlled between 1000 and 1020° C., an expanding time is controlled between 30 and 40 seconds, a retention time is controlled between 20 and 25 seconds, and an expanding deformation is controlled between 10% and 12%;
4) driving the mandrel slider by the expanding machine to move upward in the radial slider along the axial direction; driving the radial slider to synchronously aggregate along the radial direction for separating the expanding block from the profiled ring billet; and starting a guide roller on the expanding machine to rotate the profiled ring billet for 45° along a central axis, whereby finishing a first rotation of the profiled ring billet;
5) repeating step 3) for performing a second expanding on the profiled ring billet, during which, the expanding temperature of the profiled ring billet is controlled between 960 and 980° C., the expanding time is controlled between 20 and 30 seconds, the retention time is controlled between 10 and 15 seconds, and the expanding deformation is controlled between 1.8% and 2%;
6) repeating step 4) for performing a second rotation of the profiled ring billet for another 45° in the same direction of the first rotation;
7) repeating step 3) for performing a third expanding on the profiled ring billet, during which, the expanding temperature of the profiled ring billet is controlled between 930 and 950° C., the expanding time is controlled between 20 and 30 seconds; the retention time is controlled between 10 and 15 seconds, and the expanding deformation is controlled between 1.3% and 1.5%;
8) repeating step 4) for performing a third rotation of the profiled ring billet for another 45° in the same direction of the first rotation;
9) repeating step 3) for performing a fourth expanding on the profiled ring billet, during which, the expanding temperature of the profiled ring billet is controlled between 900 and 920° C., the expanding time is controlled between 30 and 40 seconds; the retention time is controlled between 25 and 28 seconds, and the expanding deformation of the profiled ring billet is controlled between 1.2% and 1.4%; and 10) allowing the mandrel slider to move upward after the fourth expanding, aggregating the radial slider, and collecting the non-rectangular section ring.

In a class of this embodiment, the high temperature alloy is a GH4169 alloy.

In a class of this embodiment, the axial tension F exerted on the mandrel slider by the expanding machine is determined by the following equation: $F=\xi\times\sigma_{0.2}\times S$, in which, $\xi$ represents an expanding coefficient of the expanding machine and is valued between 1.26 and 1.52; $\sigma_{0.2}$ represents a yield strength (megapascal) of the high temperature alloy at the expanding temperature, and $\sigma_{0.2}$ of the GH4169 alloy is valued between 380 and 430 megapascal; and S represents a longitudinal section area ($mm^2$) of the rectangular section ring or the profiled ring billet.

In a class of this embodiment, the expanding size of the non-rectangular section ring at a hot state is calculated as follows: $D=D_0(1+\beta_t)+d$, in which, D represents an inner diameter (mm) of the non-rectangular section ring at the hot state; $D_0$ represents an inner diameter (mm) of a final product of the non-rectangular section ring at a cold state; $\beta_t$ represents a temperature compensation coefficient (%) of the alloy material at the expanding temperature, and $\beta_t$ of the GH4169 alloy is between 1.5% and 1.75%; and d represents a resilience value (mm) of the inner diameter of the non-rectangular section ring after the expanding, and d of the GH4169 alloy is between 3 and 5 mm.

In a class of this embodiment, the non-rectangular section ring has an inner diameter of between Φ400 mm and Φ4500 mm, a wall thickness of between 10 and 200 mm, and a height of between 40 and 750 mm.

Advantages according to embodiments of the invention are summarized as follows:

The non-rectangular section ring is directly formed by rigid contact between the expanding block of the expanding machine and the rectangular section ring of the high temperature alloy. The method of the invention is capable of expanding high temperature alloy material that has relatively large deformation resistance and is difficult for deformation, thereby obtaining the demanded expanding dimension and improving the dimensional accuracy.

By heating the rectangular section ring to a high temperature, the method adopts one large deformation to deform the rectangular section ring to yield the profiled ring billet and adopts another three small deformations to deform the profiled ring billet into the non-rectangular section ring. Technological parameters including the expanding temperature, the expanding time, and the retention time are reasonably selected, so that neither obvious change in the tissue of the ring nor crack occurs, and the resilience value of the ring or the profiled ring billet is relatively small after each expanding process. During the expanding process, the profiled ring billet is rotated for 45° for three times in the same direction, which eliminates the traces formed on the inner circumferential surface of the profiled ring billet resulting from gaps between adjacent expanding blocks during the radial dispersion of the expanding blocks, thereby being beneficial for the expanding process and obtaining the non-rectangular section ring after the expanding having relatively high dimensional accuracy. During the whole expanding process, the expanding block is capable of real time measuring the change of the inner diameter of the profiled ring billet and the resilience value of the inner diameter after each expanding process and sending the measured data to a displayer of the expanding machine in time, so that the expanding dimension of the non-rectangular section ring can be precisely controlled during the expanding process. In a word, the non-rectangular section ring produced by the hot expansion forming method of the invention has relatively high dimensional accuracy.

During the expanding process, the axial tension F acted on the mandrel slice of the expanding machine is determined by the expanding coefficient ($\xi$), the yield strength ($\sigma_{0.2}$) of the material at the expanding temperature, and the cross section area (S) of the rectangular section ring or the profiled ring billet. Thus, the axial tension F is determined according to different expanding machines, different materials, and different ring or profiled ring billet having different dimensions, thereby resulting in a uniform and reasonable stress of the ring, ensuring a smooth expanding process, and preventing the crack caused by an excessive force or expanding failure caused by a too small force.

The inner diameter (D) of the non-rectangular section ring at the hot state is calculated by the inner diameter ($D_0$) of the final product of the non-rectangular section ring at the cold state, the temperature compensation coefficient ($\beta_t$) of the alloy material at the expanding temperature, and the resilience value (d) of the inner diameter of the non-rectangular section ring after the expanding, so that the dimension of the non-rectangular section ring at the hot state can be precisely controlled during the expanding process and the dimension of the non-rectangular section ring after the expanding at the cold state having the high accuracy is the final product dimension.

Taken non-rectangular section ring of the high temperature alloy GH4169 as an example, the dimension of the non-rectangular section ring after expanding at the cold state is the final product dimension, a dimensional accuracy reaches between 1% and 2% of the corresponding dimension. It is known from the detection that the inner tissue of non-rectangular section ring of such alloy has no obvious change, deformation, or crack.

BRIEF DESCRIPTION OF THE DRAWINGS

The invention is described hereinbelow with reference to the accompanying drawings, in which.

DETAILED DESCRIPTION OF THE EMBODIMENTS

Figure 1:
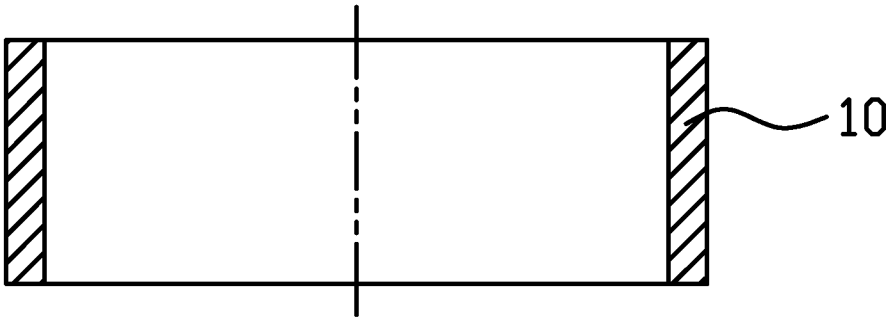
FIG. 1 is a longitudinal sectional view of a rectangular section ring along a center line.

For further illustrating the invention, experiments detailing a method for expanding a rectangular section ring to form a non-rectangular section ring are described below. It should be noted that the following examples are intended to describe and not to limit the invention.

Take the Chinese material grade GH4169 of a high temperature alloy as an example. The GH4169 alloy comprises: less than or equal to 0.08 wt. % of carbon, between 17.0 wt. % and 21.0 wt. % of Cr, between 50.0 wt. % and 55.0 wt. % of Ni, less than or equal to 1.0 wt. % of Co, between 2.80 wt. % and 3.30 wt. % of Mo, between 0.30 wt. % and 0.70 wt. % of Al, between 0.75 wt. % and 1.15 wt. % of Ti, between 4.75 wt. % and 5.50 wt. % of Nb, less than or equal to 0.006 wt. % of B, less than or equal to 0.01 wt. % of Mg, less than or equal to 0.35 wt. % of Mn, less than or equal to 0.35 wt. % of Si, less than or equal to 0.015 wt. % of P, less than or equal to 0.015 wt. % of S, less than or equal to 0.30 wt. % of Cu, less than or equal to 0.01 wt. % of Ca, less than or equal to 0.0005 wt. % of Pb, less than or equal to 0.0003 wt. % of Se, and Fe.

Figure 2:
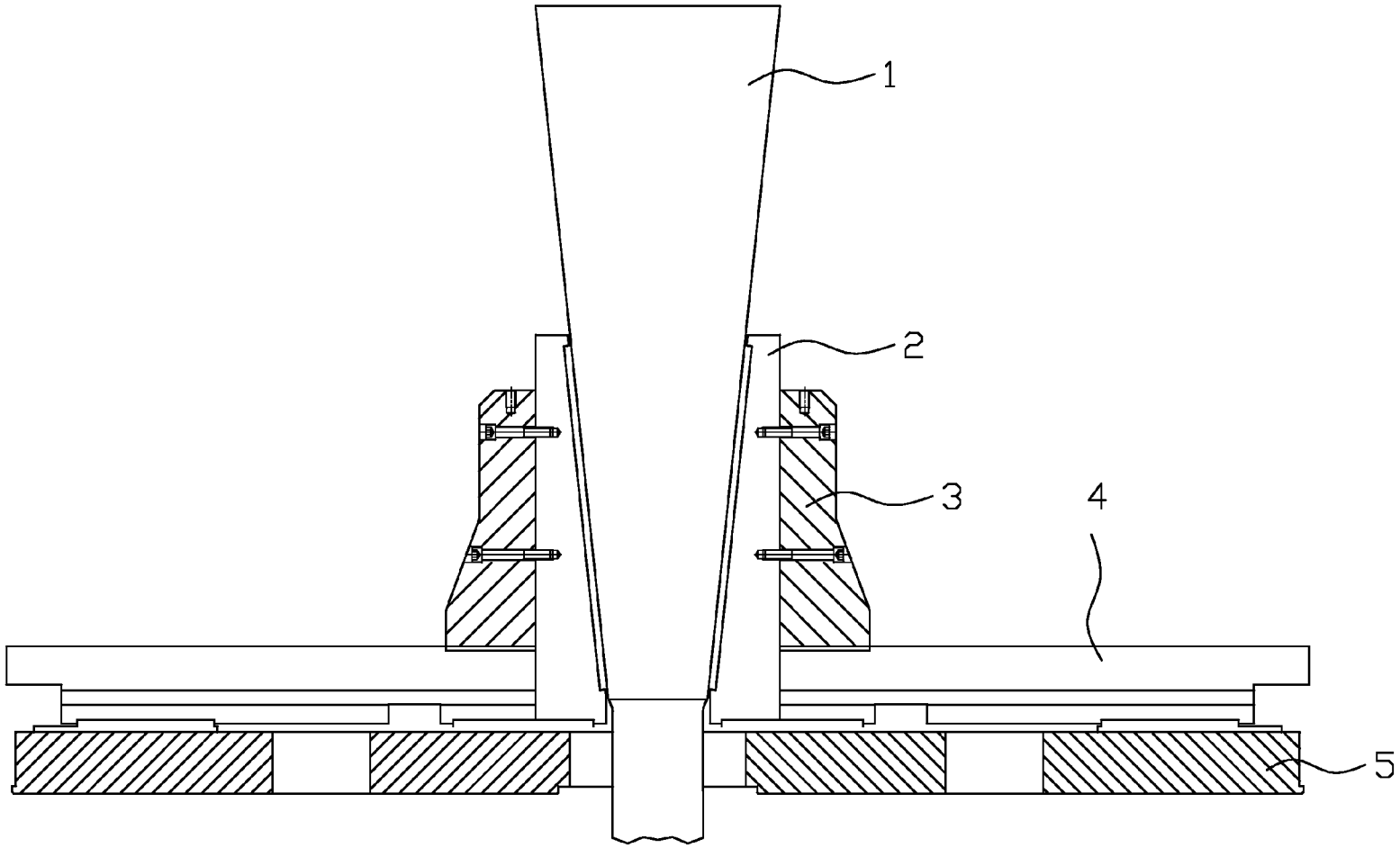
FIG. 2 is a structure diagram of an expanding machine according to one embodiment of the invention.

The hot expansion forming method is conducted on an expanding machine. As shown in FIG. 2, the expanding machine comprises: a mandrel slider 1, a radial slider 2, an expanding block 3, a workbench 4, and a guide rail 5. The mandrel slider 1 is in a conic shape and is nested within the radial slider 2 and fits a cone-shaped inner circumferential surface of the radial slider 2. The mandrel slider 1 is driven by a hydraulic cylinder of the expanding machine to move up and down inside the radial slider 2 along an axial direction and to press the radial slider 2. The radial slider 2 is mounted on the guide rail 5 of the expanding machine and is capable of moving forward and backward along the guide rail 5 in a radial direction. The radial slider 2 comprises twelve separated sectors from a top view of FIG. 2, and each part of the expanding block 3 is fixed on an outer circumferential surface of each sector, respectively. When all sectors of the radial slider 2 are aggregated, the sectors and the parts of the expanding block 3 form an annular shape. When the mandrel slider 1 moves downward along the axial direction inside the radial slider 2, each sector of the radial slider 2 synchronously spreads in the radial direction to allow the expanding block 3 to press the high temperature alloy for forming an expanded ring. When the mandrel slider 1 moves upward along the axial direction inside the radial slider 2, each sector of the radial slider 2 synchronously aggregates to allow the expanding block 3 to separate from the expanded ring. The expanding block 3 is capable of real time measuring an inner diameter of the ring during the expanding process and sending the measured data to a displayer of the expanding machine. Besides, the workbench 4 of the expanding machine is provided with a guide roller enabling to drive the ring to rotate in a central axis.

A hot expansion forming process for shaping the GH4169 alloy from a rectangular section ring to a profiled piece is as follows:

Step 1: Mounting the Rectangular Section Ring on the Expanding Machine

Figure 3:
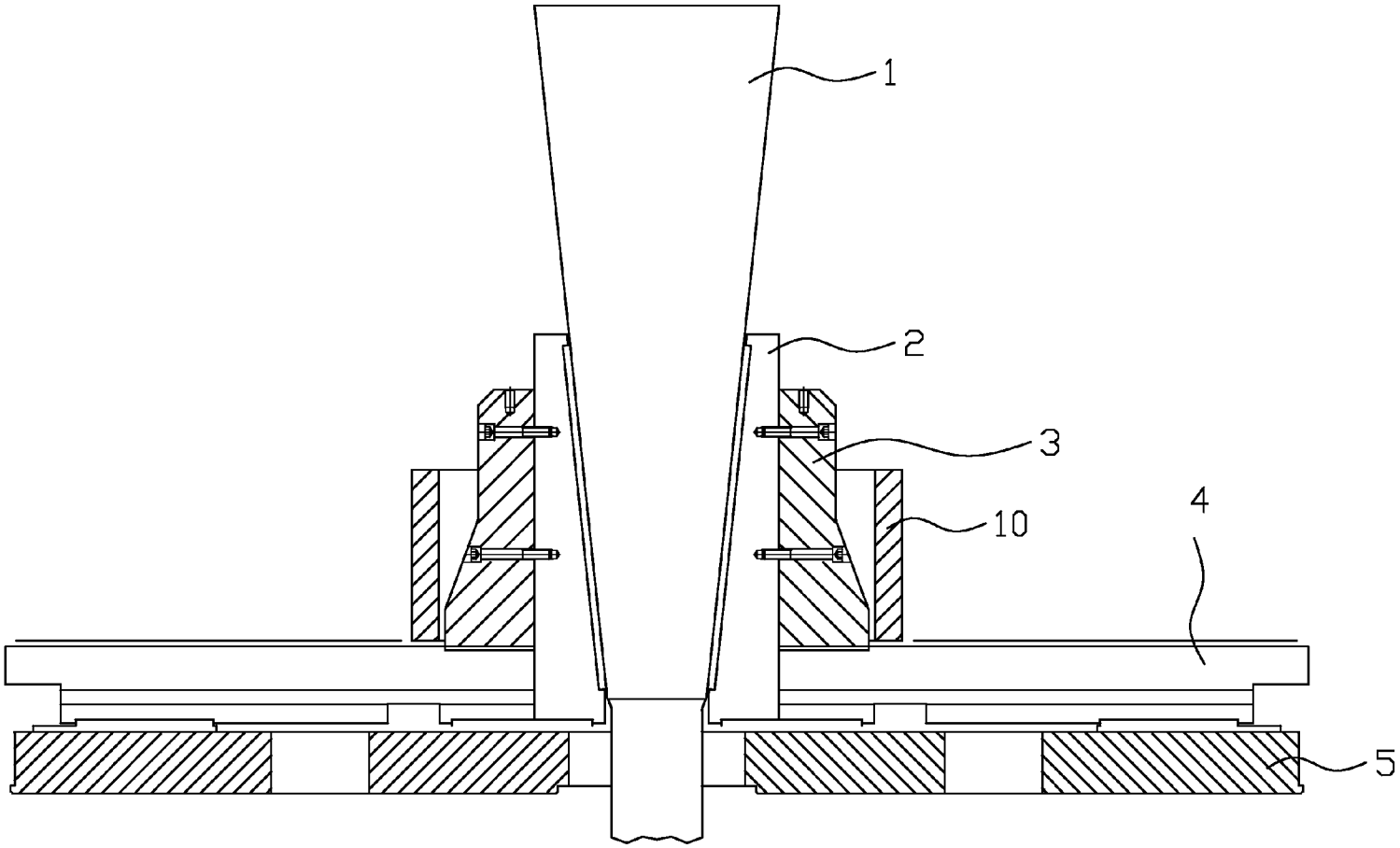
FIG. 3 is a structure diagram of a rectangular section ring mounted on an expanding machine according to one embodiment of the invention.
Figure 6:
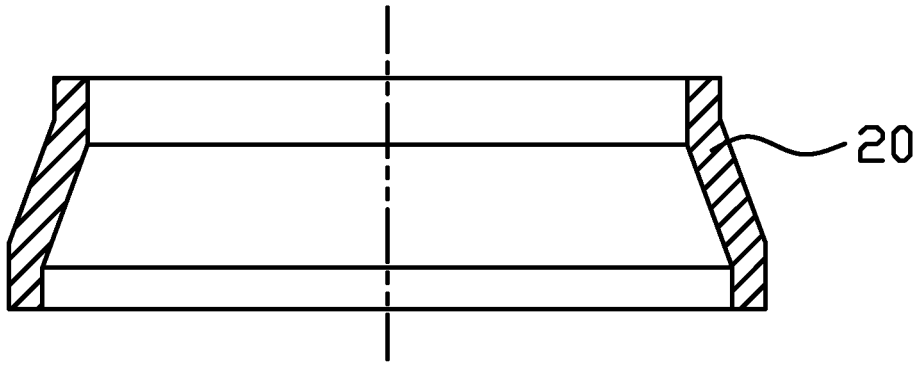
FIG. 6 is a longitudinal sectional view of a non-rectangular section ring after expanding along a center line.

As shown in FIG. 3, the expanding block 3 of the expanding machine is preheated to between 260 and 320° C. The rectangular section ring 10 of the GH4169 alloy, as shown in FIG. 1, is heated to a temperature of between 1000 and 1020° C. The rectangular section ring 10 is disposed on the expanding machine, and a periphery of the outer circumferential surface of the expanding block 3 is nested within an inner circumferential surface of the rectangular section ring 10. The outer circumferential surface of the expanding block 3 matches with an inner circumferential surface of a final non-rectangular section ring 20, as shown in FIG. 6. A bottom surface of the expanding block 3 is horizontally disposed on the workbench 4. The radial slider 2 is maintained at an aggregated state. The mounting process of the rectangular section ring on the expanding machine is completed by a manipulator.

Step 2: Performing a First Expanding

Figure 4:
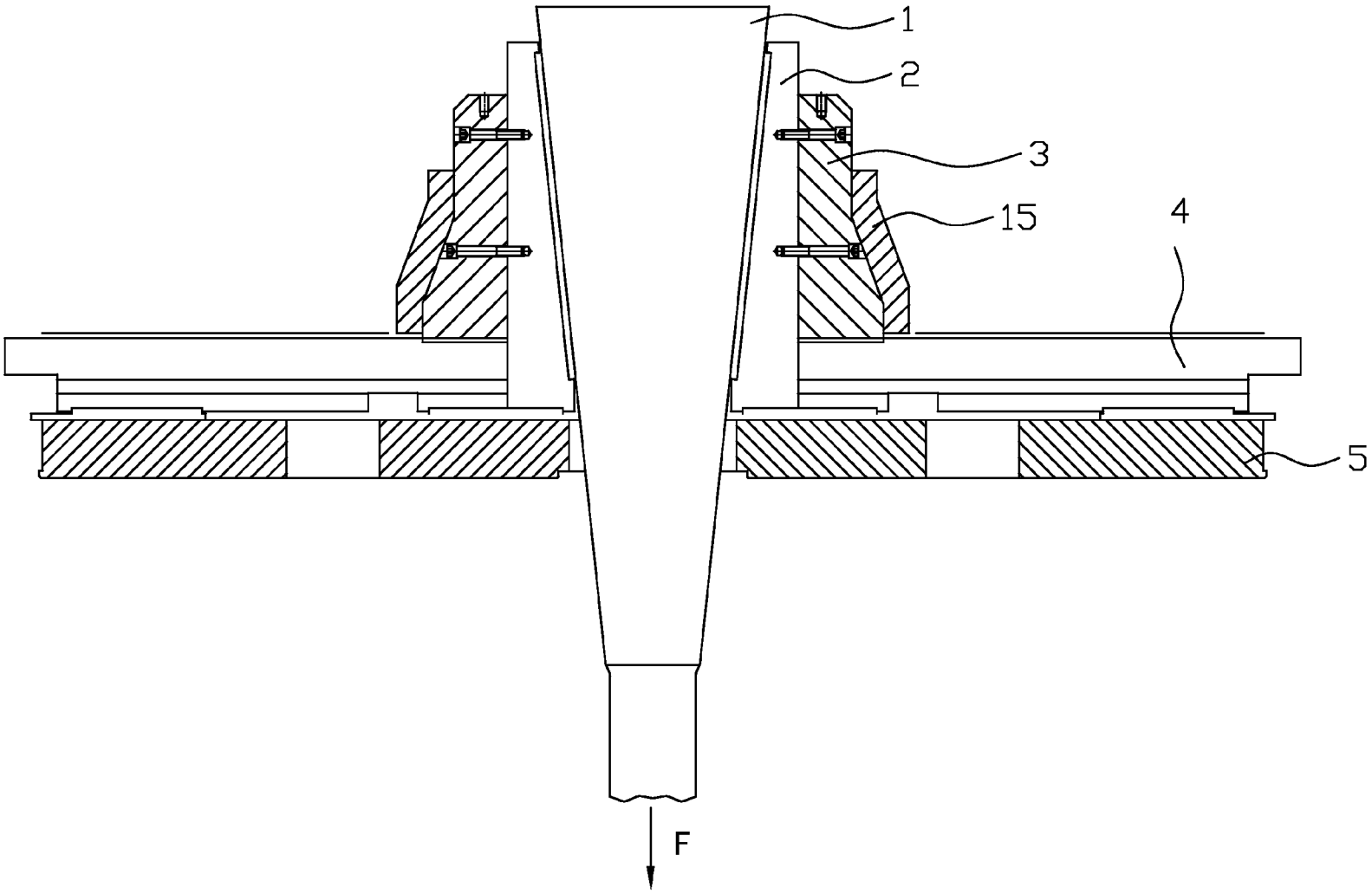
FIG. 4 is a diagram showing a process of expanding a rectangular section ring to yield a non-rectangular section ring.

As shown in FIG. 4, the expanding machine is started to enable the mandrel slider 1 to move downward in the axial direction, meanwhile, the mandrel slider 1 disposed inside the radial slider 2 presses the radial slider 2 along the conical surface of the radial slider 2 to allow each radial slider 2 to synchronously disperse in the radial direction. The outer circumferential surface of the expanding block 3 arranged on the radial slider 2 presses the rectangular section ring 10 along the inner circumferential surface of the rectangular section ring 10. Thus, a radial press is exerted by the expanding block 3 on the rectangular section ring 10 from the inner circumferential surface to the outer circumferential surface thereof, which results in a radial expansion of the inner circumferential surface of the rectangular section ring 10, and plastic deformation occurs including enlargement of the inner diameter and the outer diameter of the rectangular section ring 10 and reduction of the wall thickness. The rectangular section ring 10 deforms into a profiled ring billet 15 after the first expansion by the expanding block 3. During the first expanding process, an axial tension F is exerted on the mandrel slider 1 by a hydraulic cylinder of the expanding machine, the expanding temperature of the rectangular section ring 10 is controlled between 1000 and 1020° C., an expanding time is controlled between 30 and 40 seconds; a retention time is controlled between 20 and 25 seconds, and an expanding deformation of the rectangular section ring is between 10% and 12%.

The expanding time refers the duration from the start of the expanding of the rectangular section ring to the end of the expanding process. The retention time refers the duration from when the deformation of the rectangular section ring 10 reaches the expanding deformation and no more deformation occurs until the expanding process is finished.

Step 3: Performing a First Rotation

Figure 5:
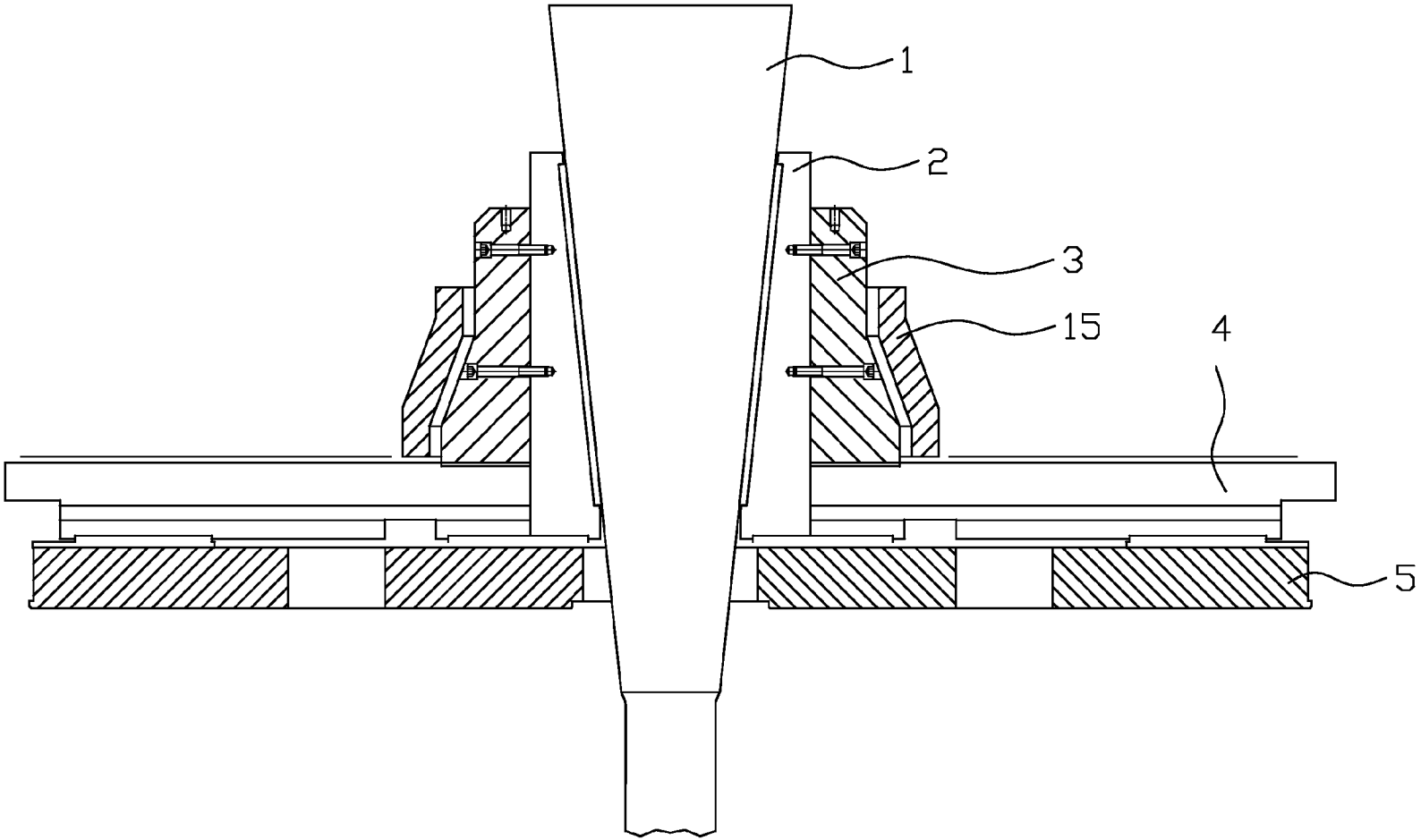
FIG. 5 is a diagram showing separation of an expanding block from a non-rectangular section ring after expanding.

As shown in FIG. 5, the mandrel slider 1 is driven by the expanding machine to move upward inside the radial slider 2 along the axial direction and to drive the radial slider 2 to synchronously aggregate for separating the expanding block 3 from the profiled ring billet 15. The guide roller arranged on the workbench 4 of the expanding machine is started and drives the profiled ring billet 15 to rotate on the workbench 4 along the central axis at a clockwise direction or a counterclockwise direction for 45°, whereby finishing the first rotation of the profiled ring billet 15.

Step 4: Performing a Second Expanding

The expanding process of step 1) is repeated to perform a second expanding process on the profiled ring billet 15 by the expanding block 3. During the second expanding process, the axial tension F is exerted on the mandrel slider 1 by the hydraulic cylinder of the expanding machine. The expanding temperature of the profiled ring billet 15 is controlled between 960 and 980° C., the expanding time is controlled between 20 and 30 seconds, the retention time is controlled between 10 and 15 seconds, and the expanding deformation is controlled between 1.8% and 2%.

Step 5: Performing a Second Rotation

Step 3) is repeated to drive the profiled ring billet 15 to rotate for another 45° in the same direction of the first rotation, whereby finishing the second rotation of the profiled ring billet 15.

Step 6: Performing a Third Expanding

The expanding process of step 1) is repeated to perform the third expanding process on the profiled ring billet 15 by the expanding block 3. During the third expanding process, the axial tension F is exerted on the mandrel slider 1 by the hydraulic cylinder of the expanding machine. The expanding temperature of the profiled ring billet 15 is controlled between 930° C. and 950° C., the expanding time is controlled between 20 and 30 seconds, the retention time is controlled between 10 and 15 seconds, and the expanding deformation is controlled between 1.3% and 1.5%.

Step 7: Performing a Third Rotation

Step 3) is repeated to drive the profiled ring billet 15 to rotate for another 45° in the same direction of the second rotation, whereby finishing the third rotation of the profiled ring billet 15.

Step 8: Performing a Fourth Expanding

The expanding process of step 1) is repeated to perform the fourth expanding process on the profiled ring billet 15 by the expanding block 3 to yield the final non-rectangular section ring 20. During the fourth expanding process, the axial tension F is exerted on the mandrel slider 1 by the hydraulic cylinder of the expanding machine. The expanding temperature of the profiled ring billet 15 is controlled between 900 and 920° C., the expanding time is controlled between 30 and 40 seconds, the retention time is controlled between 25 and 28 seconds, and the expanding deformation of the profiled ring billet 15 is controlled between 1.2% and 1.4%.

After the fourth expanding processes, the mandrel slider 1 moves upward, the radial slider 2 aggregates to separate the expanding block 3 from the non-rectangular section ring 20, and the non-rectangular section ring 20 is collected by the manipulator.

During the expanding process of the rectangular section ring 10 or the profiled ring billet 15, the axial tension F is calculated as follows:

$$F=\xi\times\sigma_{0.2}\times S$$

in which, $\xi$ represents an expanding coefficient of the expanding machine and is valued between 1.26 and 1.52; $\sigma_{0.2}$ represents a yield strength (megapascal) of the high temperature alloy at the expanding temperature and is valued between 380 and 430 megapascal; and S represents a longitudinal section area ($mm^2$) of the rectangular section ring 10 or the profiled ring billet 15.

The expanding deformation of the rectangular section ring 10 is calculated as follows:

Expanding deformation={[Pitch diameter of the rectangular section ring 10 (or the profiled ring billet 15) after expanding−Pitch diameter of the rectangular section ring 10 (or the profiled ring billet 15) before expanding]/Pitch diameter of the rectangular section ring 10 (or the profiled ring billet 15) before expanding}×100%.

Pitch diameter of the rectangular section ring 10 (or the profiled ring billet 15)=(Inner diameter of the rectangular section ring 10 (or the profiled ring billet 15)+Outer diameter of the rectangular section ring 10 (or the profiled ring billet 15))÷2.

To ensure a required size of the final product after the expanding deformation of the rectangular section ring 10 into the non-rectangular section ring 20, the expanding size of the non-rectangular section ring 20 at the hot state is calculated as follows:

$$D=D_0(1+\beta_t)+d$$

in which, D represents the inner diameter (mm) of the non-rectangular section ring 20 at the hot state; $D_0$ represents the inner diameter (mm) of the final product of the non-rectangular section ring 20 at a cold state; $\beta_t$ represents a temperature compensation coefficient (%) of the alloy material at the expanding temperature, different materials has different temperature compensation coefficient at different temperature, and herein the temperature compensation coefficient is valued between 1.5% and 1.75%; and d represents a resilience value (mm) of the inner diameter of the non-rectangular section ring 20 after expanding, and the resilience value herein is valued between 3 and 5 mm.

The above dimensions in the calculation are all dimensions of the maximum deformation, and herein are dimensions of large end face, or the bottom end face, of the rectangular section ring 10 or the profiled ring billet 15.

The non-rectangular section ring of the high temperature alloy formed by using the above hot expansion forming method has an inner diameter of between Φ400 mm and Φ4500 mm, a wall thickness of between 10 and 200 mm, and a height of between 40 and 750 mm.

The non-rectangular section ring is directly formed through the rigid contact between the expanding block of the expanding machine and the rectangular section ring of the high temperature alloy. The method of the invention is capable of expanding high temperature alloy material that has relatively large deformation resistance and is difficult for deformation, thereby obtaining the demanded expanding dimension and improving the dimensional accuracy. It is known from the detection that the dimension of the alloy non-rectangular section ring at the cold state after the expansion forming process, that is, the final product dimension, has a dimensional accuracy reaching between 1% and 2% of the corresponding dimension, and that the inner tissue of non-rectangular section ring of such alloy has no obvious change, deformation, or crack. This method is applicable for producing the non-rectangular section ring of the high temperature alloy rotator parts such as cylindrical casing in the field of aerospace.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for expanding a rectangular section ring to form a non-rectangular section ring, the method comprising:

1) providing an expanding machine comprising a mandrel slider, a radial slider, and an expanding block, the expanding block comprising an outer circumferential surface matching an inner circumferential surface of a finally-obtained non-rectangular section ring;

2) heating a rectangular section ring of an alloy comprising an inner circumferential surface to a temperature of between 1000 and 1020° C., preheating the expanding block to a temperature of between 260 and 320° C., nesting the inner circumferential surface of the rectangular section ring on a periphery of the outer circumferential surface of the expanding block of the expanding machine, and allowing the radial slider in an aggregated state;

3) starting the expanding machine, exerting an axial tension F on the mandrel slider to enable the mandrel slider to move downward along an axial direction and to press an inner conic surface of the radial slider thereby synchronously dispersing each part of the radial slider in a radial direction; allowing the expanding block disposed on an outer circumferential surface of the radial slider to press the inner circumferential surface of the rectangular section ring in the radial direction; and expanding an inner diameter and an outer diameter of the rectangular section ring and decreasing a wall thickness thereof for deforming the rectangular section ring to yield a profiled ring billet, whereby finishing a first expanding, during which, an expanding temperature of the rectangular section ring is controlled between 1000 and 1020° C., an expanding time is controlled between 30 and 40 seconds, a retention time is controlled between 20 and 25 seconds, and an expanding deformation is controlled between 10% and 12%;

4) driving the mandrel slider by the expanding machine to move upward in the radial slider along the axial direction; driving the radial slider to synchronously aggregate along the radial direction for separating the expanding block from the profiled ring billet; and starting a guide roller on the expanding machine to rotate the profiled ring billet for 45° along a central axis, whereby finishing a first rotation of the profiled ring billet;

5) repeating step 3) for performing a second expanding on the profiled ring billet, during which, the expanding temperature of the profiled ring billet is controlled between 960 and 980° C., the expanding time is controlled between 20 and 30 seconds, the retention time is controlled between 10 and 15 seconds, and the expanding deformation is controlled between 1.8% and 2%;

6) repeating step 4) for performing a second rotation of the profiled ring billet for another 45° in the same direction of the first rotation;

7) repeating step 3) for performing a third expanding on the profiled ring billet, during which, the expanding temperature of the profiled ring billet is controlled between 930 and 950° C., the expanding time is controlled between 20 and 30 seconds, the retention time is controlled between 10 and 15 seconds, and the expanding deformation is controlled between 1.3% and 1.5%;

8) repeating step 4) for performing a third rotation of the profiled ring billet for another 45° in the same direction of the first rotation;

9) repeating step 3) for performing a fourth expanding on the profiled ring billet, during which, the expanding temperature of the profiled ring billet is controlled between 900 and 920° C., the expanding time is controlled between 30 and 40 seconds, the retention time is controlled between 25 and 28 seconds, and the expanding deformation of the profiled ring billet is controlled between 1.2% and 1.4%; and 10) allowing the mandrel slider to move upward after the fourth expanding, aggregating the radial slider, and collecting the non-rectangular section ring.

2. The method of claim 1, wherein the alloy is a GH4169 alloy.

3. The method of claim 1, wherein the axial tension F exerted on the mandrel slider by the expanding machine is determined by the following equation:

$$F=\xi\times\sigma_{0.2}\times S$$

in which, $\xi$ represents an expanding coefficient of the expanding machine and is valued between 1.26 and 1.52;

$\sigma_{0.2}$ represents a yield strength (megapascal) of the alloy at the expanding temperature, and $\sigma_{0.2}$ of a GH4169 alloy is valued between 380 and 430 megapascal; and S represents a longitudinal section area ($mm^2$) of the rectangular section ring or the profiled ring billet.

4. The method of claim 2, wherein the axial tension F exerted on the mandrel slider by the expanding machine is determined by the following equation:

$$F=\xi\times\sigma_{0.2}\times S$$

in which, $\xi$ represents an expanding coefficient of the expanding machine and is valued between 1.26 and 1.52;

$\sigma_{0.2}$ represents a yield strength (megapascal) of the alloy at the expanding temperature, and $\sigma_{0.2}$ of the GH4169 alloy is valued between 380 and 430 megapascal; and S represents a longitudinal section area ($mm^2$) of the rectangular section ring or the profiled ring billet.

5. The method of claim 1, wherein the expanding size of the non-rectangular section ring at a hot state is calculated as follows:

$$D=D_0(1+\beta_t)+d$$

in which,

D represents an inner diameter (mm) of the non-rectangular section ring at the hot state;

$D_0$ represents an inner diameter (mm) of a final product of the non-rectangular section ring at a cold state;

$\beta_t$ represents a temperature compensation coefficient (%) of the alloy material at the expanding temperature, and $\beta_t$ of a GH4169 alloy is between 1.5% and 1.75%; and d represents a resilience value (mm) of the inner diameter of the non-rectangular section ring after the expanding; and d of a GH4169 alloy is between 3 and 5 mm.

6. The method of claim 2, wherein the expanding size of the non-rectangular section ring at a hot state is calculated as follows:

$$D=D_0(1+\beta_t)+d$$

in which,

D represents an inner diameter (mm) of the non-rectangular section ring at the hot state;

$D_0$ represents an inner diameter (mm) of a final product of the non-rectangular section ring at a cold state;

$\beta_t$ represents a temperature compensation coefficient (%) of the alloy material at the expanding temperature, and $\beta_t$ of the GH4169 alloy is between 1.5% and 1.75%; and d represents a resilience value (mm) of the inner diameter of the non-rectangular section ring after the expanding; and d of the GH4169 alloy is between 3 and 5 mm.

7. The method of claim 1, wherein the non-rectangular section ring has an inner diameter of between Φ400 mm and Φ4500 mm, a wall thickness of between 10 and 200 mm, and a height of between 40 and 750 mm.

8. The method of claim 2, wherein the non-rectangular section ring has an inner diameter of between Φ400 mm and Φ4500 mm, a wall thickness of between 10 and 200 mm, and a height of between 40 and 750 mm.

* * * * *